US005290410A

United States Patent [19]

Tenfält et al.

[11] Patent Number: 5,290,410

[45] Date of Patent: Mar. 1, 1994

[54] ELECTRODE AND ITS USE IN CHLOR-ALKALI ELECTROLYSIS

[75] Inventors: Mikael Tenfält; Anders Ullman, both of Ljungaverk, Sweden

[73] Assignee: Permascand AB, Ljungaverk, Sweden

[21] Appl. No.: 944,954

[22] Filed: Sep. 15, 1992

[30] Foreign Application Priority Data

Sep. 19, 1991 [SE] Sweden ..... 9102712

[51] Int. Cl.[5] ..... C25B 11/02

[52] U.S. Cl. ..... 204/98; 204/242; 204/252; 204/280; 204/284; 204/290 R; 204/128

[58] Field of Search ..... 204/280, 284, 290 R, 204/128, 98, 252, 242; C25B 11/02, 11/03

[56] References Cited

U.S. PATENT DOCUMENTS

| | | | |
|---|---|---|---|
| 3,980,545 | 9/1976 | de Lachaux et al. | 204/286 |
| 4,124,479 | 11/1978 | Boulton | 204/256 |
| 4,126,534 | 11/1978 | Boulton | 204/266 |
| 4,149,956 | 4/1979 | Bess, Sr. et al. | 204/284 |
| 4,211,628 | 7/1980 | Obata et al. | 204/252 |
| 4,252,628 | 2/1981 | Boulton et al. | 204/284 |
| 4,391,695 | 7/1983 | Koziol et al. | 204/286 |
| 4,627,897 | 12/1986 | Tetzlaff | 204/59 R |

FOREIGN PATENT DOCUMENTS

| | | | |
|---|---|---|---|
| 902297 | 8/1985 | Belgium . | |
| 498467 | 12/1953 | Canada . | |
| 0383243 | 8/1990 | European Pat. Off. . | |
| 0415896 | 3/1991 | European Pat. Off. . | |
| 897839 | 10/1953 | Fed. Rep. of Germany . | |
| 2538000 | 4/1976 | Fed. Rep. of Germany . | |
| 2721958 | 11/1978 | Fed. Rep. of Germany | 204/280 |
| 568253 | 3/1924 | France . | |
| 2606794 | 3/1988 | France . | |
| 0250026 | 9/1987 | German Democratic Rep. | C25B 11/02 |
| 0619546 | 8/1978 | U.S.S.R. | 204/280 |
| 1324427 | 7/1973 | United Kingdom . | |

*Primary Examiner*—Kathryn Gorgos

*Attorney, Agent, or Firm*—Burns, Doane, Swecker & Mathis

[57] ABSTRACT

The invention relates to an electrode for electrolysis, whose front side comprises a plurality of substantially parallel channels defined by substantially parallel threads of electrically conducting material, which are attached to and in electric contact with the underlying electrode structure. Moreover, the invention relates to a method of producing an electrode, an electrolytic cell comprising an electrode according to the invention, and the use of such an electrode in electrolysis.

13 Claims, 1 Drawing Sheet

ELECTRODE AND ITS USE IN CHLOR-ALKALI ELECTROLYSIS

BACKGROUND OF THE INVENTION

The present invention relates to an electrode whose front side is fitted with channel-forming threads, a method of producing an electrode, an electrolytic cell comprising an electrode according to the invention, and the use of such an electrode in electrolysis.

In electrolytic processes, the electric current is in many cases a predominant item of expenditure, and therefore a reduction of every unnecessary resistance in the electrolytic cell is desired. For example, the distance between the anode and the cathode should be as short as possible, without interfering with the flow of the electrolyte. For optimum utilisation of the material in electrolytic cells, also the surface of the electrodes in relation to the volume thereof should be as large as possible.

In many processes gas develops, which means that accumulation of gas bubbles between the anode and the cathode must be prevented so as not to increase the cell resistance. In some processes it is also common practice to separate the anode chamber and the cathode chamber by an ion-selective membrane arranged between the anode and the cathode, like in, for example, the production of chlorine and alkali. Chlorine gas forms at the anode, and to be able to fully utilise the front side of the anode for the electrolysis, the electrolyte should be able to flow freely along the anode surface. Therefore, the membrane should not engage the anode too closely, at the same time as it should be as close as possible to be able to minimise the distance between the anode and the cathode. Moreover, the electrolysis is generally carried out under excess pressure in the cathode chamber, which presses the membrane against the anode surface. These problems are difficult to solve, since available ion-selective membranes are very thin and mechanically yieldable, at the same time as they are most fragile and easily damaged when subjected to mechanical stress.

The above-mentioned problems are dealt with in EP 415,896 relating to an electrode whose front side is embossed with circulation channels for the electrolyte which are not clogged even if the membrane engages the electrode.

In many cases, modern electrodes are formed with a catalytic coating in order to optimise the desired reactions. A problem which then arises is that the catalytic activity is gradually lost in the surroundings which in many cases are corrosive. This problem is taken care of in FR 2,606,794 which suggests that the electrodes comprise a base structure and a thin net which is point-welded to the base structure and can readily be replaced when its catalytic activity has become unsatisfactory. A similar solution is suggested in BE 902,297.

DE patent 2538000 discloses a bipolar electrode construction comprising a base plate and a grid-like electrode. The electrode is not intended for use in memory brane cells.

SUMMARY OF THE INVENTION

The invention aims at providing a surface-enlarged electrode which facilitates the circulation of electrolyte and the removal of gas and which should also be possible to use in electrolytic cells containing thin, yieldable and fragile membranes. More specifically, the invention relates to an electrode for electrolysis, whose front side comprises a plurality of substantially parallel channels defined by substantially parallel threads of electrically conducting material which are attached to and in electric contact with the underlying electrode structure. By front side, it is meant the side intended to face an electrode of opposite polarity, which side preferably has its essential extent in the vertical plane. In a membrane cell, the front side faces the membrane. Preferably, the channels are substantially straight, and if the front side is substantially vertical, the channel-forming threads suitably make an angle with the horizontal plane from about 45° to about 90°, preferably from about 60 to about 90° . Most preferably, the threads and channels extend in substantially vertical direction.

Preferably, the channels and the threads are substantially uniform over the electrode front side which may have a size of e.g. from about 0.1 to about 5 $m^2$, but this size is in no way critical. The geometric cross-section of the threads is not critical either; they may be for example circular, oval, rectangular or triangular, even if for economical reasons they preferably are substantially circular. Any forwardly facing edges should, however, be rounded so as to prevent a fragile membrane, if any, from being damaged. The underlying electrode structure preferably comprises through openings to facilitate the circulation of the electrolyte.

Optimal function is achieved if the channels are narrow and the channel forming threads are thin. Thin threads and narrow channels improve the transport of gas bubbles and the circulation of electrolyte, particularly in membrane cells in which a thin and yielding membrane can engage the threads without curving into the channels and cause obstruction. Suitably, the channel-forming threads have a thickness of from about 0.05 to about 3 mm, preferably from about 0.2 to about 1.5 mm. In case the threads are not circular, the thickness of the broadest part of the thread is measured in parallel with the extent of the electrode. In such cases, it is also convenient that the height of the threads perpendicularly to the extent of the electrode is in the same size order as their thickness. The distance between the threads is suitably from about 0.1.d to about 4.d, preferably from about 0.5 d to about 2.d, d being the thread thickness. The distance is measured as the shortest distance between two threads.

To increase the mechanical stability, the channel-forming threads can be attached in transverse, preferably substantially perpendicular stabilizing threads which extend between the channel-forming threads and the underlying electrode structure. The channel-forming threads and the stabilizing threads are suitably in contact with each other via preferably laser-welded fixing points at which they intersect. The stabilizing threads can be straight or extend in a regularly or irregularly wave-shaped pattern, optionally to be adapted to the surface of the underlying electrode structure. Moreover, the stabilizing threads are preferably as thick as or thicker than the channel-forming threads, and they suitably have a thickness from about 0.5 to about 5 mm, preferably from about 1 to about 3 mm. The distance between the stabilizing threads is not critical and can be, for example, from about 5 to about 100 mm, preferably from about 25 to about 50 mm.

If the electrode is to be used with a membrane which can easily be damaged, the surface of the channel forming threads on the electrode is suitably smooth and substantially free from sharp portions which, for example, might be caused by welding sparks. It has been found possible to obtain an electrode without sharp portions on the channel-forming threads by joining said threads to the underlying electrode structure by means of contactless welding, e.g. laser welding or electron beam welding, either directly, which results in optimal current distribution, or via the transverse stabilizing threads, if any, which further reduces the risk of welding sparks on said channel-forming threads. .The threads which are attached directly to the underlying electrode structure are suitably attached thereto by means of a plurality of contactlessly welded fixing points in each thread; the preferred distance between the fixing points in each thread being from about 5.d to about 100.d, especially from about 10.d to about 50.d, d being the thickness of the thread.

The electrode above is especially suitable for electrolysis in which gas develops, particularly if the electrolyte is flowing upwardly as the ascending gas bubbles improve the circulation, and especially for electrolysis in membrane cells, i.e. electrolytic cells where the anode chamber and the cathode chamber are separated by an ion-selective membrane. The electrode is particularly advantageous in electrolytic production of chlorine and alkali in membrane cells, but is also very useful in electrochemical recovery of metals or recovery of gases from diluted solutions.

The threads result in the electrode front side having a large number of unbroken channels for circulation of the electrolyte and efficient removal of any gas formed. In a membrane cell, the thickness of the threads and the width of the channels are preferably of the same side order as the thickness of the membrane which, therefore, can engage the threads without clogging the channels, thus eliminating the risk of accumulation of any gas bubbles formed. Consequently, the electrode gap can be very small, minimizing the cell resistance, and the current distribution through the membrane is more uniform than in prior art electrodes, increasing the life time of the expensive membrane. In chlorine-alkali electrolyses, it has been found that the alkaline film close to the membrane is flushed away by acid anolyte, thus avoiding unwanted absorption of chlorine and formation of oxygen. The threads also result in the electrode surface being considerably enlarged, for example from about 2 to about 5 times, which increases the efficiency of the cell and reduces the electrode potential so as to prolong the service life of the electrode. The surface enlargement also affects the selectivity of the reaction, e.g. the formation of chlorine gas being promoted in the electrolysis of weak chloride solutions. Irrespective of the electrolysis process, an electrode according to the invention may be monopolar or bipolar.

It has appeared to be possible to produce the new electrode in a comparatively simple manner by attaching the threads to a prior art electrode, preferably an electrode having through openings. As examples of prior art electrodes that may be modified, mention can be made of perforated plate electrodes, electrodes of expanded metal, electrodes having longitudinal or transverse rods, or electrodes including bent or straight lamellae punched from a common metal sheet, which lamellae can extend vertically or horizontally, for example louver-type electrodes. These types of electrode are well known to those skilled in the art and are described in e.g. the abovementioned EP 415,896 and in GB 1,324,427. A particularly preferred electrode according to the invention is a louvertype electrode whose front side is provided with threads as described above.

The entire electrode, i.e. both the threads and the underlying structure, is suitably made of the same material, for example Ti, V, Cr, Mn, Fe, Co, Ni, Cu, Zr, Nb, Ag, Pt, Ta, Pb, Al or alloys thereof. If the electrode is to function as an anode, Ti or Ti alloys are preferred, whereas Fe, Ni or alloys thereof are preferred if the electrode is to function as a cathode. It is also preferred that both the threads and the underlying structure are activated by some suitable, catalytically active material, depending on the intended use as an anode or a cathode. Also, electrodes in which the threads only are activated may be used. Useful catalytic materials are metals, metal oxides or mixtures thereof from Group 8B in the Periodic Table, i.e. Fe, Co, Ni, Ru, Rh, Pd, Os, Ir, or Pt, among which Ir and Ru are especially preferred.

The invention also relates to a method of producing an electrode comprising one or more threads attached to the surface, said method comprising applying the threads to an underlying structure by a plurality of contactlessly welded fixing points along each thread. Among possible contactless welding methods, mention can be made of electron beam welding or laser welding, of which the latter is preferred. To minimize the risk of welding sparks and ensuing irregularities on the threads, the laser welding is suitably effected in lateral direction, preferably substantially perpendicularly to the long side of the thread, and preferably at an angle to the contact surface of the underlying electrode structure from about 5° to about 60°, especially from about 15° to about 45°.

In contrast to ordinary point welding, contactless welding as mentioned above results in an extremely small, needle-shaped joint at the actual point of contact, whereas the remainder of the thread is essentially unaffected, making the method particularly suitable for thin threads, preferably from about 0.05 to about 5 mm thick most preferably from about 0.5 to abou 3 mm thick. The electric contact is good, at the same time as the threads can be mechanically pulled off, without damaging the underlying structure. Subsequently, the electrode can again be provided with threads, without necessitating any further processing, which facilitates regeneration of passivated electrodes. The welding method can be used for welding of all metals that are normally used in the production of electrodes, and has proved highly advantageous, inter alia, if the threads and/or the underlying structure are made of titanium or some titanium alloy. Owing to the high capacity in laser welding, the time of production can be made short, especially if a number of laser sources, for example from 1 to about 10, are arranged in parallel in a welding unit. Also beam division with optical arrangements, for example with optical fibres, may be used.

The method is especially suitable in the production of an electrode according to the invention. The threads applied can thus themselves form circulation channels on the electrode surface or have stabilizing function for channel-forming threads communicating with these. According to the method, it is, however, also possible to apply threads so as to form other geometric patterns, or such that the threads applied constitute a support structure for other types of surface-enlarging, circulation-promoting or catalytically active elements.

When producing an electrode comprising channel-forming threads and stabilising threads extending transversely thereof, the threads can first be composed to form a grid-like structure which is then contactlessly welded to the underlying electrode structure, either via the channel-forming threads or via the transverse threads. However, it is also possible first to provide the underlying electrode structure with threads extending in one direction and then provide these threads with transverse threads.

The method can be applied both when producing electrodes and when modifying existing electrodes. In the production of electrodes, any activation with catalytic coating is, for practical reasons, preferably carried out after application of the threads. An existing, activated electrode can, however, be provided with activated threads, without the active coating being damaged during the laser welding. It is also possible to provide a non-activated electrode or an electrode whose activity has faded after being used for a long time, with activated threads. Regarding preferred dimensions and materials, reference is made to the description of the electrode according to the invention.

The actual welding is preferably carried out by means of a pulsed solid state laser, for example an YAG laser, the pulse duration being from about 1 to about 500 ms, preferably from about 1 to about 100 ms, and the average power being from about 10 to about 200 W.

Furthermore, the invention relates to an electrolytic cell comprising at least one electrode fitted with channel-forming threads according to the invention. Preferably it also comprises an ion-selective membrane arranged between the anode and the cathode so as to engage the threads of the electrode according to the invention. If the cell is intended for electrolysis of alkali metal chloride solution to chlorine gas and alkali, the anode should be an electrode with threads, preferably a louver-type electrode fitted with threads, while the cathode can be the same or a similar type of electrode, however, without threads. Most preferably, the cell is included in a filter press type electrolyser. Besides, the cell can be designed according to conventional techniques, well known to those skilled in the art.

Finally, the invention relates to a method in electrolysis, at least one of the electrodes being an electrode with channel-forming threads according to the invention. The method is especially suitable in electrolysis involving development of gas, the electrode(s) in which the gas develops preferably being an electrode fitted with threads according to the invention, the electrolyte preferably flowing upwardly. The method is especially suitable in electrolysis in a membrane cell, particularly in electrolysis of an alkali metal solution, for example sodium or potassium chloride solution, for the production of chlorine and alkali, the anode preferably being an electrode fitted with threads according to the invention, while the cathode may be of conventional type. Besides, the electrolysis may be carried out according to conventional techniques, well known to those skilled in the art.

BRIEF DESCRIPTION OF THE DRAWINGS

The invention will now be described in more detail with reference to the accompanying drawings. However, the invention is not restricted to the embodiments illustrated, but many other variants are feasible within the scope of the claims.

FIG. 1 is a schematic top plan view illustrating the production of an electrode, while FIG. 3 is a schematic side view of a detail of an electrode including stabilising threads, while

DETAILED DESCRIPTION OF THE PREFERRED EMBODIMENTS

Figure 1:
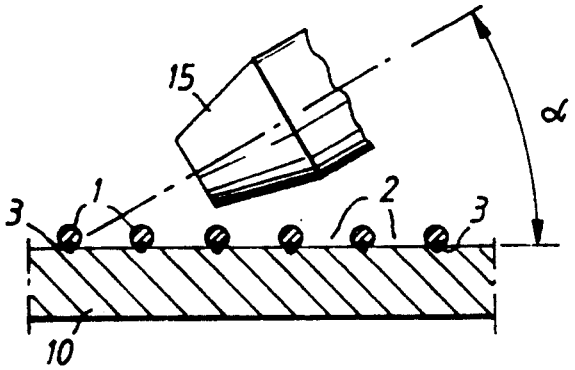
Figure 2:
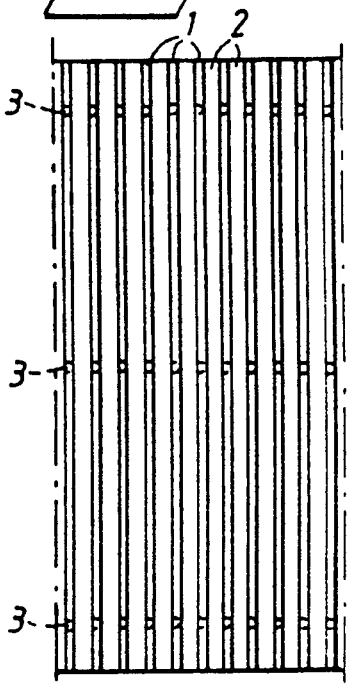
FIG. 2 is a front view of a detail of the finished electrode.

FIGS. 1 and 2 illustrate a plurality of parallel threads 1 which via laser-welded contact points 3 are attached to an underlying electrode structure 10 and form vertical channels 2 on the front side of the electrode. FIG. 1 illustrates how a laser welding unit 15 is directed towards the contact point from the long side of the thread at an angle c to the contact surface of the underlying electrode structure, said angle preferably being from about 5° to about 60°. In FIG. 2, the position of the welding points 3, which are normally not seen from above, has been marked.

Figure 3:
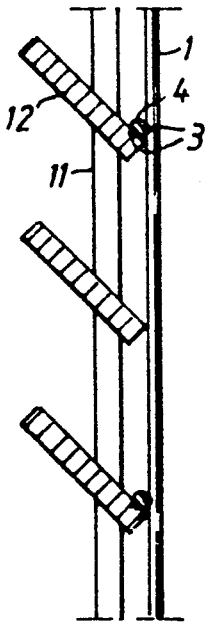
Figure 4:
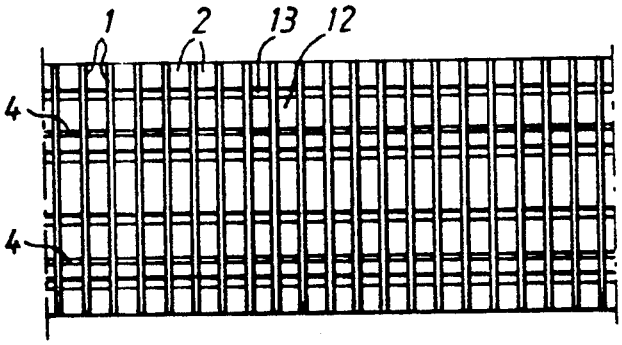
FIG. 4 is a front view of a detail of the same electrode.

FIGS. 3 and 4 illustrate a louver-type electrode comprising louvers 12 punched from a common metal sheet 11 so that through openings 13 are formed in the electrode structure. The electrode further comprises vertical channels 2 defined by channel-forming threads 1 which via laser-welded contact points 3 are attached to stabilizing transverse threads 4. The stabilizing threads 4 extends along every second louver 12, whereby the channel-forming threads 1 are also supported by the louvers. By this design, substantially completely unbroken channels 2 are formed along the front side of the electrode. In the embodiment shown, the stabilizing threads 4 are attached to the louvers 12 by means of laser-welded contact points 3, but it is also possible instead to attach, by laser welding, the channel-forming threads 1 to the louvers 12. It is also obvious to those skilled in the art that the distance between the transverse threads 4 may be varied according to the stability requirements.

We claim:

1. An electrode for electrolysis, comprising a front side having an electrolytically active portion and having a plurality of substantially parallel channels defined by substantially parallel threads of electrically conducting material, said conducting material is attached to and in electric contact with an underlying electrode structure comprising through openings.

2. An electrode as claimed in claim 1, wherein the front side of the electrode has its essential extent in the vertical plane, and the channel-forming threads make an angle with the horizontal plane from about 45° to about 90°.

3. An electrode as claimed in claim 2, wherein the channel-forming threads have a thickness from about 0.05 to about 3 mm, and the distance between said threads is from about 0.1.d to about 4.d, d is the thickness of said threads.

4. An electrode as claimed in claim 1 wherein the channel-forming threads are attached to transverse stabilizing threads positioned between the channel-forming threads and the underlying electrode structure.

5. An electrode as claimed in claim 1, wherein the surface of the channel-forming threads is smooth and substantially free from sharp portions.

6. An electrolytic cell including at least one electrode comprising a front side having an electrolytically active portion and having a plurality of substantially parallel channels defined by substantially parallel threads of electrically conducting material, said conducting material is attached to and in electric contact with an underlying electrode structure comprising through openings.

7. An electrolytic cell as claimed in claim 6, wherein the cell includes an anode and a cathode, and an ion-selective membrane arranged between the anode and the cathode.

8. An electrolytic cell claimed in claim 6, wherein the front side of the electrode has its essential extend in the vertical plane, and the channel-forming threads make an angle with the horizontal plane from about 45° to about 90°.

9. A method for performing electrolysis, including the steps of applying electric current to an electrode having a front side having an electrically active portion and with a plurality of substantially parallel channels structure.

10. A method as claimed in claim 9, wherein said electrode is part of a membrane cell.

11. A method as claimed in claim 9, including the step of electrolyzing an alkali metal chloride solution to chlorine and alkali, and wherein said electrode having channel-forming threads is the anode.

12. An electrode for electrolysis, comprising a front side having an electrolytically active portion and having a plurality of substantially parallel channels defined by substantially parallel threads of electrically conducting material, said conducting material is attached to and in electric contact with an underlying electrode structure, wherein the channel-forming threads have a thickness from about 0.05 to about 3 mm, and the distance between said threads is from about 0.1.d to about 4.d, d is the thickness of said threads.

13. An electrolytic cell including at least one electrode comprising a front side having an electrolytically active portion and having a plurality of substantially parallel channels defined by substantially parallel threads of electrically conducting material, said conducting material is attached to and in electric contact with an underlying electrode structure, wherein the channel-forming threads have a thickness from about 0.05 to about 3 mm, and the distance between said threads if from about 0.1.d to about 4.d, d is the thickness of said threads.

* * * * *